US011105211B2

(12) United States Patent
Lee et al.

(10) Patent No.: US 11,105,211 B2
(45) Date of Patent: Aug. 31, 2021

(54) TRANSITION PIECE ASSEMBLY, TRANSITION PIECE MODULE, AND COMBUSTOR AND GAS TURBINE INCLUDING TRANSITION PIECE ASSEMBLY

(71) Applicant: DOOSAN HEAVY INDUSTRIES & CONSTRUCTION CO., LTD., Changwon-si (KR)

(72) Inventors: Dong Gon Lee, Seoul (KR); Jae Won Seo, Changwon-si (KR)

( * ) Notice: Subject to any disclaimer, the term of this patent is extended or adjusted under 35 U.S.C. 154(b) by 0 days.

(21) Appl. No.: 16/799,821

(22) Filed: Feb. 24, 2020

(65) Prior Publication Data

US 2020/0291799 A1 Sep. 17, 2020

(30) Foreign Application Priority Data

Mar. 12, 2019 (KR) ..... 10-2019-0028087

(51) Int. Cl.
*F23R 3/60* (2006.01)
*F01D 9/02* (2006.01)
*F23R 3/00* (2006.01)

(52) U.S. Cl.
CPC ..... *F01D 9/023* (2013.01); *F23R 3/002* (2013.01); *F05D 2240/14* (2013.01);
(Continued)

(58) Field of Classification Search
CPC .. F01D 9/023; F23R 3/002; F23R 3/60; F23R 2900/00017; F05D 2240/14; F05D 2240/35; F05D 2260/22141; F05D 2260/30
See application file for complete search history.

(56) References Cited

U.S. PATENT DOCUMENTS 3,759,038 A * 9/1973 Scalzo ..... F01D 9/023 60/800
4,297,843 A 11/1981 Sato et al.
(Continued)

FOREIGN PATENT DOCUMENTS

EP 1207273 A2 5/2002
JP S55 81228 A 6/1980
(Continued)

OTHER PUBLICATIONS

Office Action dated Jan. 12, 2021 by the Japanese Patent Office.
Office Action dated Apr. 6, 2021 by the Japanese Patent Office.

*Primary Examiner* — Steven M Sutherland
(74) *Attorney, Agent, or Firm* — Harvest IP Law, LLP

(57) ABSTRACT

A transition piece assembly improves the cooling of a transition piece by increasing a flow of compressed air toward a transition piece casing. The assembly includes a transition piece including an inlet and an outlet; a transition piece casing spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows; a support member for supporting the transition piece casing, the support member inserted into the annular interspace and seated on the outer circumferential surface of the transition piece; and a guide member that is fixed with respect to the transition piece casing and includes an axially perpendicular structure to guide the compressed air toward the transition piece casing.

19 Claims, 5 Drawing Sheets

(52) U.S. Cl.
CPC ..... *F05D 2240/35* (2013.01); *F05D 2260/22141* (2013.01); *F05D 2260/30* (2013.01); *F23R 3/60* (2013.01); *F23R 2900/00017* (2013.01)

(56) References Cited

U.S. PATENT DOCUMENTS

| | | | | |
|---|---|---|---|---|
| 4,903,477 | A * | 2/1990 | Butt | F01D 25/14 60/39.37 |
| 8,448,444 | B2 * | 5/2013 | Cihlar | F23R 3/002 60/772 |
| 2012/0186269 | A1 | 7/2012 | Cihlar et al. | |
| 2012/0247112 | A1 | 10/2012 | Narcus et al. | |

FOREIGN PATENT DOCUMENTS

| | | | |
|---|---|---|---|
| JP | S56 52525 | A | 5/1981 |
| JP | S55 164731 | A | 12/1981 |
| JP | S59 115826 | U | 8/1984 |
| JP | 2012154613 | A | 8/2012 |
| JP | 2013139799 | A | 7/2013 |
| JP | 5554636 | B2 | 6/2014 |
| KR | 101770516 | B1 | 8/2017 |

* cited by examiner

[FIG. 2]

[FIG. 3]
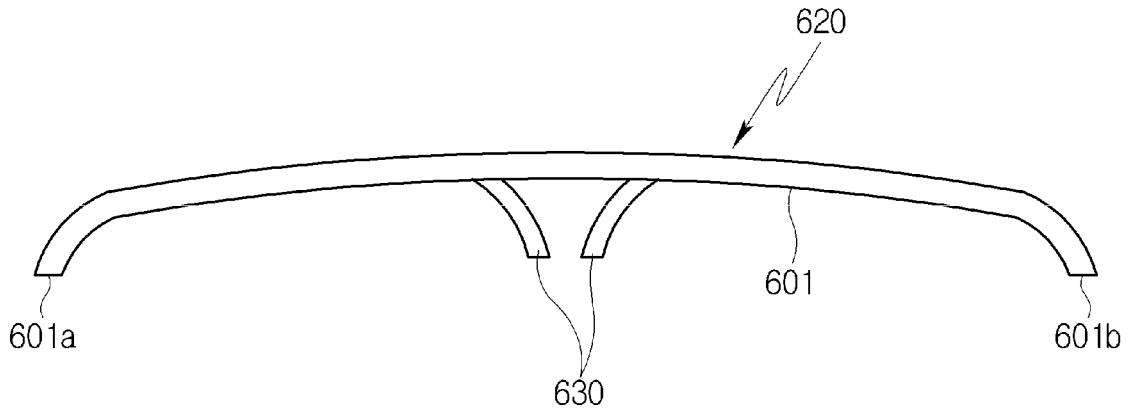
[FIG. 4]
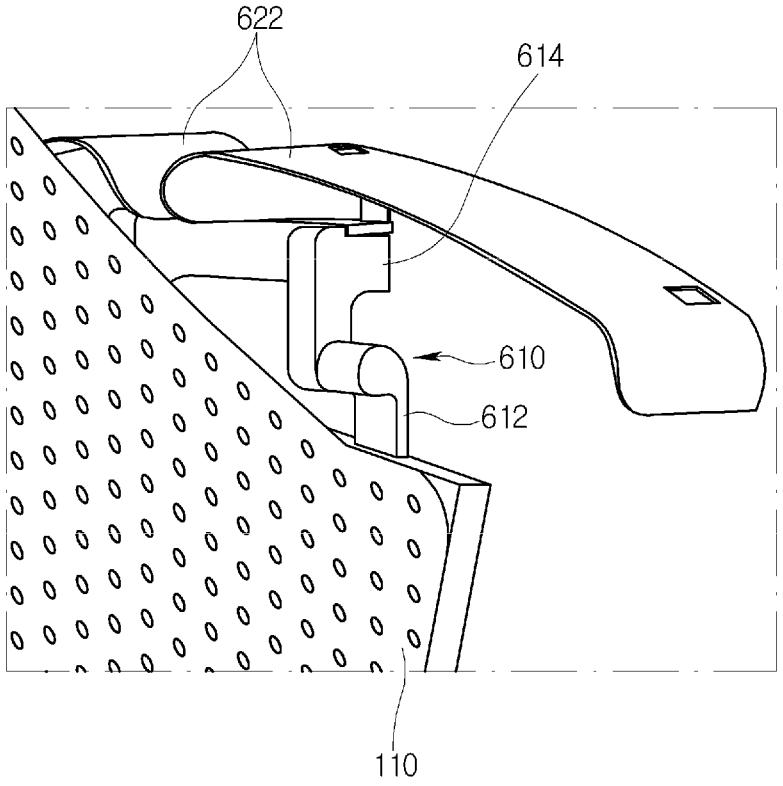

[FIG. 5]
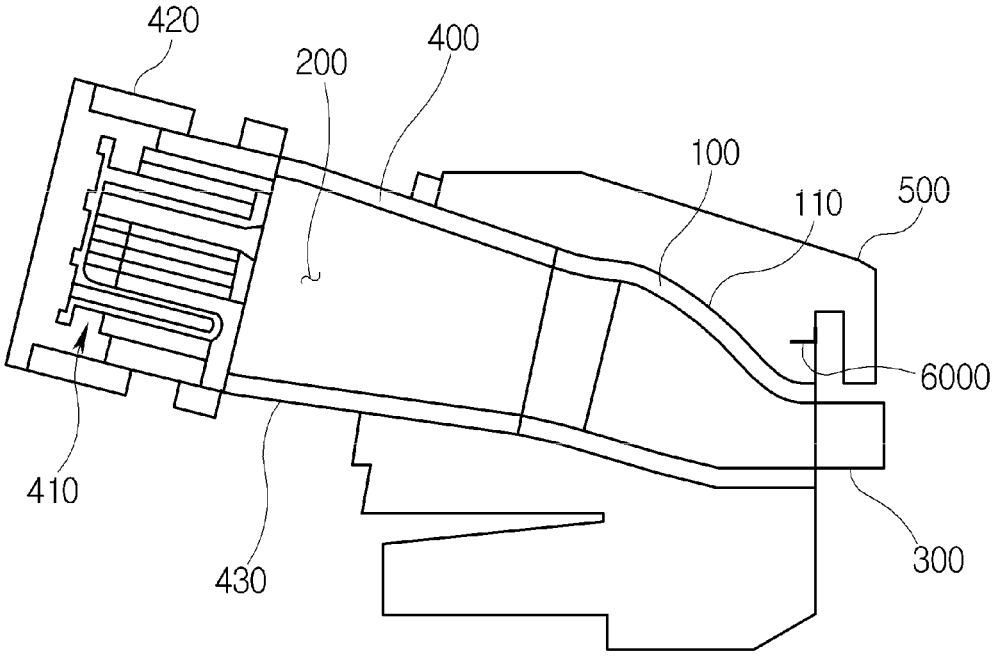
[FIG. 6]
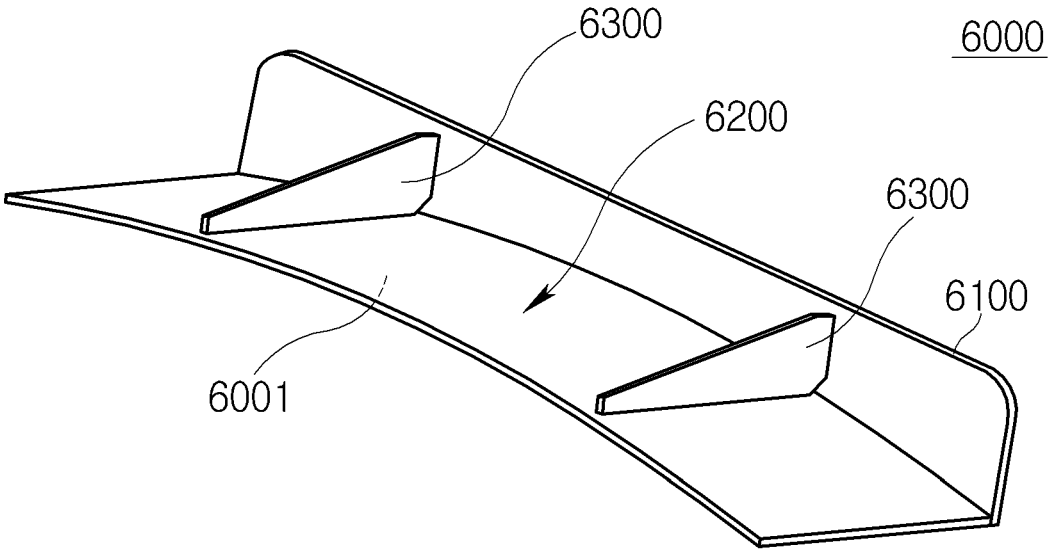

[FIG. 7]
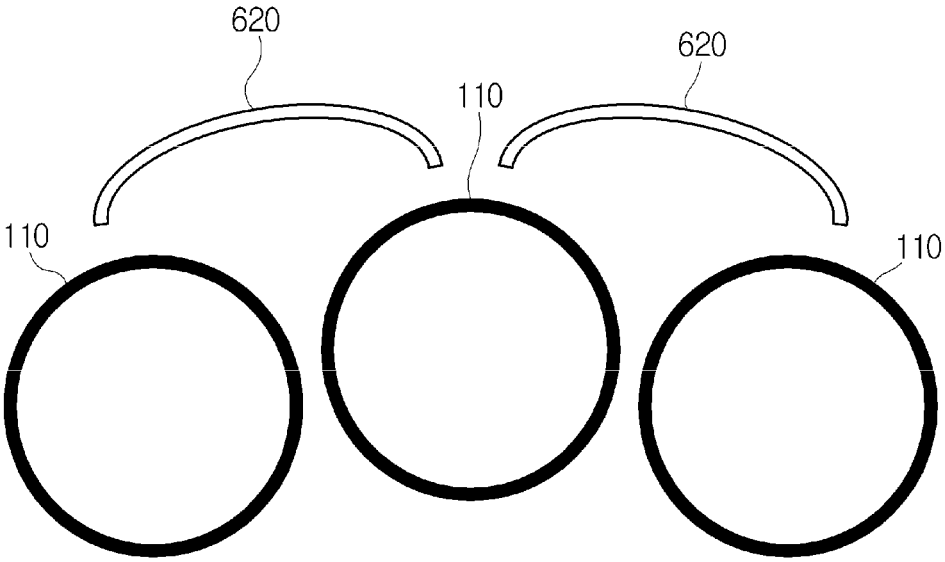
[FIG. 8A]
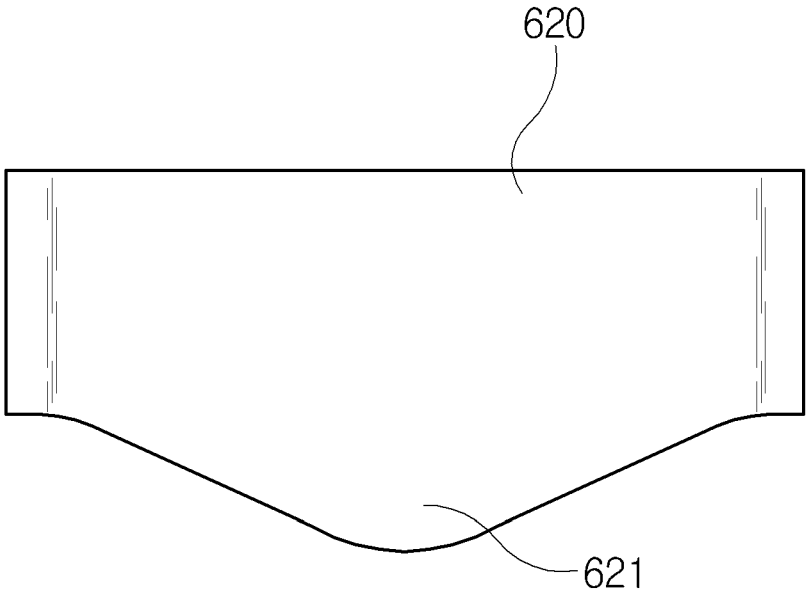

[FIG. 8B]
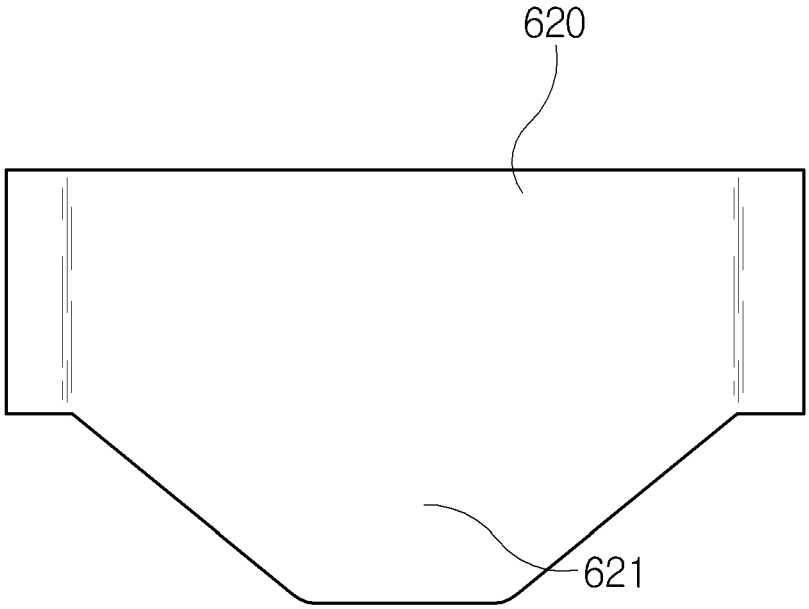

TRANSITION PIECE ASSEMBLY, TRANSITION PIECE MODULE, AND COMBUSTOR AND GAS TURBINE INCLUDING TRANSITION PIECE ASSEMBLY

CROSS-REFERENCE TO RELATED APPLICATION

This application claims priority to Korean Patent Application No. 10-2019-0028087, filed on Mar. 12, 2019, the disclosure of which is incorporated herein by reference in its entirety.

BACKGROUND OF THE DISCLOSURE

Field of the Disclosure

Exemplary embodiments of the present disclosure relate to a transition piece assembly, and more particularly, to a transition piece assembly capable of improving cooling efficiency of a transition piece.

Discussion of Related Art

Generally, a gas turbine is a power engine which combusts fuel and compressed air generated from a compressor, generates high-temperature gas, and rotates a turbine using the high-temperature gas. Such gas turbines are used for combined cycle power generation, thermal cogeneration, etc.

A gas turbine is roughly divided into a compressor, a combustor, and a turbine. The compressor functions to draw air and compress the air to a high pressure using some of the power generated by the rotation of the turbine. Compressed air is transmitted to the combustor.

The combustor mixes the compressed air with fuel, generates a flow of high-temperature combustion gas by burning the mixture, and discharges the combustion gas toward the turbine. The discharged combustion gas rotates the turbine to generate rotating force. A combustor for an industrial gas turbine includes a plurality of fuel nozzle modules arranged in an annular configuration. The mixing of air and fuel is performed in the fuel nozzle modules.

Air compressed by the compressor is drawn into the combustor. Fuel is injected through a vane disposed in each of the fuel nozzle modules and then mixed with air. A mixture of fuel and air is combusted in a plurality of combustion chambers respectively disposed at a downstream side of each of the fuel nozzle modules. Combustion gas is discharged through a passage extending to the turbine.

High-temperature combustion gas is drawn from the combustion chamber into the turbine through a transition piece and thus drives the turbine. During a process in which combustion gas flows toward the turbine, heat is transferred from the combustion gas to the transition piece because of the high temperature of the combustion gas. To prevent damage to the transition piece or a casing that encloses the transition piece the transition piece casing, which may be caused by overheating, the transition piece and its casing must be cooled.

SUMMARY OF THE DISCLOSURE

An object of the present disclosure is to provide a transition piece assembly, a transition piece module, and a combustor and a gas turbine including the same, which can increase the amount of compressed air flowing to a transition piece and a transition piece casing.

Other objects and advantages of the present disclosure can be understood by the following description, and become apparent with reference to the embodiments of the present disclosure. Also, it will be clear to those skilled in the art to which the present disclosure pertains that the objects and advantages of the present disclosure can be realized by the means as claimed and combinations thereof.

In accordance with one aspect of the present disclosure, a transition piece assembly may include a transition piece including an inlet into which high-temperature combustion gas is drawn, and an outlet from which the combustion gas is discharged to a turbine inlet port; a transition piece casing disposed so as to be spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows to cool the transition piece; a support member for supporting the transition piece casing, the support member inserted into the annular interspace and seated on the outer circumferential surface of the transition piece; and a guide member that is fixed with respect to the transition piece casing and includes an axially perpendicular structure configured to guide the compressed air toward the transition piece casing.

The axially perpendicular structure of the guide member may include a single guide including a guide surface that is formed on the axially perpendicular structure and that faces the outer circumferential surface of the transition piece casing so that the compressed air is guided into the transition piece casing; or dual guides symmetrically arranged with respect to each other and respectively configured to guide a portion of the compressed air into the transition piece casing, each of the dual guides including a guide surface that is formed on the axially perpendicular structure and that faces the outer circumferential surface of the transition piece casing so that the compressed air is guided into the transition piece casing.

The transition piece assembly may further include a turbine casing spaced apart from the transition piece casing and configured to enclose the transition piece casing, the turbine casing having an inner wall facing the transition piece casing, wherein the axially perpendicular structure of the guide member include a turbine casing guide that is fixed to the inner wall of the turbine casing and includes a guide surface facing the outer circumferential surface of the transition piece casing so that the compressed air, which flows over the outer circumferential surface of the transition piece casing and toward the turbine casing, is guided into the transition piece casing.

The axially perpendicular structure of the guide member may include one or both of a central protrusion that extends from the axially perpendicular structure in a downstream direction and is configured to increase an amount of compressed air that collides with the axially perpendicular structure to be guided into the transition piece casing; and opposite end portions that are respectively curved radially inward toward the transition piece casing and are configured to collect the compressed air that collides with the guide member and to guide the collected compressed air into the transition piece casing. The opposite end portions may be separated by a distance greater than a distance between opposite side portions of the transition piece casing.

The axially perpendicular structure of the guide member may include at least one inner guide having one end portion oriented toward the transition piece casing, and the at least one inner guide may include a pair of inner guides disposed so as to be symmetrical with each other and to face each other.

The guide member may further include a guide support that is fixed to the transition piece casing and is configured to support the guide member with respect to the transition piece casing; and a guide surface that is formed on the axially perpendicular structure and faces the outer circumferential surface of the transition piece casing so that the compressed air is guided into the transition piece casing. The guide support may include a mount disposed on the transition piece casing; and a rotatable arm having opposite ends respectively coupled to the mount and the guide member, the rotatable arm configured to rotate such that the guide surface changes its position relative to the transition piece casing.

The turbine casing guide may further include a coupling crosspiece that is coupled to the inner sidewall of the turbine casing and is configured to support the turbine casing guide with respect to the transition piece casing. The turbine casing guide may further include at least one rib structurally contacting one surface of the coupling crosspiece, wherein the one surface of the coupling crosspiece faces away from the inner wall of the turbine casing, and the at least one rib is configured to reinforce the support of the turbine casing guide by the coupling crosspiece; or at least one rib structurally contacting one surface of the turbine casing guide, wherein the one surface of the turbine casing guide faces away from the guide surface of the turbine casing guide, and the at least one rib is configured to reinforce the support of the turbine casing guide by the coupling crosspiece. On the other hand, the at least one rib may make structural contact with both the one surface of the turbine casing guide and the one surface of the coupling crosspiece.

In accordance with another aspect of the present disclosure, there is provided a transition piece module including a plurality of transition piece assemblies arranged in an annular configuration. Each of the transition piece assemblies may include a transition piece including an inlet into which high-temperature combustion gas is drawn, and an outlet from which the combustion gas is discharged to a turbine inlet port; a transition piece casing disposed so as to be spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows to cool the transition piece; and a support member for supporting the transition piece casing, the support member inserted into the annular interspace and seated on the outer circumferential surface of the transition piece. The plurality of transition piece assemblies may include an adjacent pair transition piece assemblies, and the transition piece module may further include a guide member that is disposed between the transition piece casings of the adjacent pair of transition piece assemblies and that includes an axially perpendicular structure configured to guide the compressed air toward the transition piece casings of the adjacent pair of transition piece assemblies.

The guide member of the transition piece module may further include a guide support that is fixed to at least one of the transition piece casings of the adjacent pair of transition piece assemblies and is configured to support the guide member with respect to the at least one of the transition piece casings; and a guide surface that is formed on the axially perpendicular structure and faces the outer circumferential surfaces of the transition piece casings of the adjacent pair of transition piece assemblies so that the compressed air is guided into the transition piece casings of the adjacent pair of transition piece assemblies. The axially perpendicular structure of the guide member may include opposite end portions including a first end portion curved inwardly toward a first transition piece casing of the adjacent pair of transition piece assemblies and a second end portion curved inwardly toward a second transition piece casing of the adjacent pair of transition piece assemblies, and the opposite end portions may be configured to collect the compressed air that collides with the guide member and to guide the collected compressed air into the first and second transition piece casings.

The transition piece module may further include a turbine casing spaced apart from the transition piece casing and configured to enclose the transition piece casing, the turbine casing having an inner wall facing the transition piece casing, and the axially perpendicular structure of the guide member may include opposite end portions including a first end portion curved inwardly toward a first transition piece casing of the adjacent pair of transition piece assemblies and a second end portion curved inwardly toward a second transition piece casing of the adjacent pair of transition piece assemblies, the opposite end portions configured to collect the compressed air that collides with the guide member and to guide the collected compressed air into the first and second transition piece casings; and a turbine casing guide that is fixed to the inner wall of the turbine casing. The turbine casing guide may include a coupling crosspiece that is coupled to the inner wall of the turbine casing and is configured to support the turbine casing guide with respect to the transition piece casing, and a guide surface that is formed on the axially perpendicular structure and faces the outer circumferential surfaces of the transition piece casings of the adjacent pair of transition piece assemblies so that the compressed air is guided into the transition piece casings of the adjacent pair of transition piece assemblies.

In accordance with another aspect of the present disclosure, there is provided a combustor for producing combustion gas by combusting a mixture of compressed air and fuel. The combustor may include a fuel nozzle module including a plurality of fuel nozzle assemblies configured to supply the fuel; a casing enclosing the fuel nozzle module; a liner coupled with the fuel nozzle module and having internal space in which the fuel-air mixture is combusted; a liner casing enclosing the liner; and a transition piece assembly coupled with the liner and the liner casing. Here, the transition piece assembly is consistent with the above. Further, there is provided a gas turbine including the above combustor and which may further include a compressor configured to generate the compressed air from air drawn in from an outside; and a turbine configured to be driven by the combustion gas.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 2 is a perspective view of the transition piece assembly in accordance with the embodiment of the present disclosure;

FIG. 3 is a sectional view of a single guide of the transition piece assembly shown in FIG. 2;

FIG. 4 is a perspective view of a portion of the transition piece assembly including dual guides in accordance with a modification of the embodiment of FIG. 3;

FIG. 5 is a conceptual diagram schematically illustrating a section of a combustor in accordance with another embodiment of the present disclosure;

FIG. 6 is a perspective view of a turbine casing guide in accordance with the embodiment of FIG. 5;

FIG. 7 is a conceptual diagram illustrating guide members respectively disposed between adjacent transition piece casings in accordance with another embodiment of the present disclosure; and FIGS. 8A and 8B are plan views illustrating examples of guide members of including a central protrusion.

DETAILED DESCRIPTION

Hereinafter, embodiments of the present disclosure will be described with reference to the accompanying drawings. In addition, when an element described herein is referred to as "comprising" or "including" a component, the description does not preclude the inclusion of another component unless the context clearly indicates otherwise.

Figure 1:
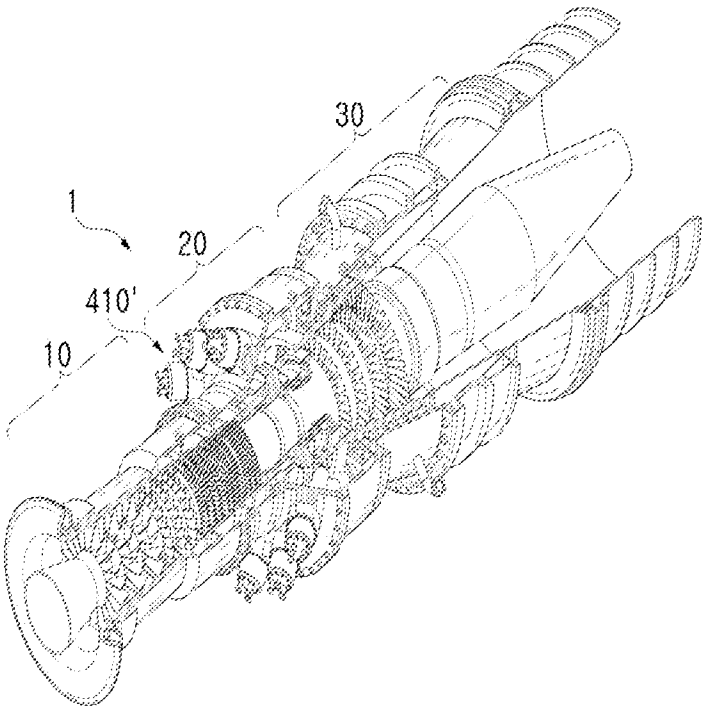
FIG. 1 is a perspective view illustrating a gate turbine to which may be applied a transition piece assembly and a transition piece module in accordance with an embodiment of the present disclosure.
Figure 1:
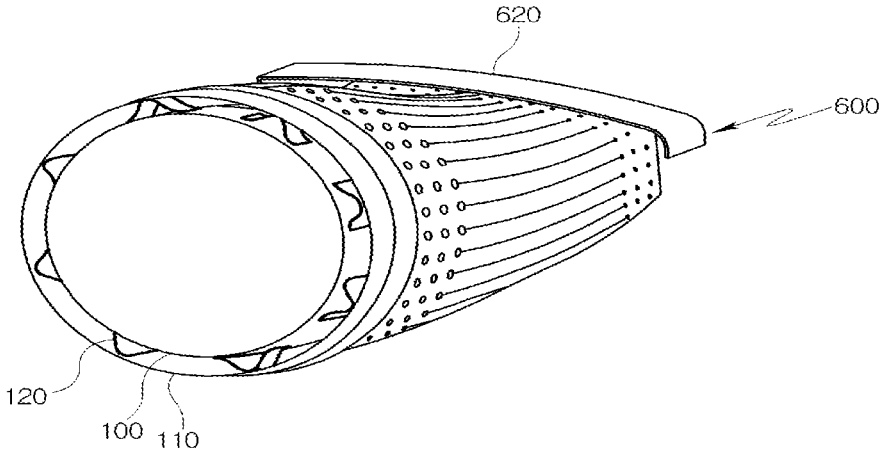

Referring to FIG. 1, the gas turbine 1 includes a compressor 10, a combustor 20, and a turbine 30, and is a power engine configured to mix compressed air output from the compressor 10 with fuel in the combustor 20, combust the mixture of the air and the fuel, and thus rotate the turbine 30. The transition piece assembly in accordance with the present disclosure is included in the combustor 20.

Referring to FIG. 2, the transition piece assembly includes a transition piece 100 through which passes high-temperature combustion gas that is ignited and combusted in a combustion chamber 200 (FIG. 5). The high-temperature combustion gas that has passed through the transition piece 100 is drawn into the turbine 30.

To allow the combustion gas to pass through the transition piece 100, the transition piece 100 includes an inlet into which the combustion gas is drawn, and an outlet from which the combustion gas is discharged toward a turbine inlet port. A passage, along which the combustion gas can flow, is formed between the inlet and the outlet. As illustrated in FIG. 2, the inlet of the transition piece 100 is larger than its outlet, but the relative sizes of the inlet and the outlet are not particularly limited.

In addition, as illustrated in FIG. 2, the transition piece 100 includes a portion formed toward the inlet to be coupled with a cylindrical liner 400 (FIG. 5) and a portion formed toward the outlet to be coupled to a turbine inlet port 300 (FIG. 5). The inlet-side portion of the transition piece 100 may have a circular shape, and the outlet-side portion may have a quadrangular shape approximating a rectangle with rounded corners, but these shapes are not particularly limited. The quadrangular shape corresponds to the shape of the turbine inlet port 300, wherein the longer sides of the approximate rectangle formed by the outlet side portion of the transition piece 100 extend in the circumferential direction of the gas turbine 1, and the longer sides extend in the radial direction of the gas turbine 1.

As shown in the sectional view of FIG. 5, the transition piece 100 includes a lower portion and an upper portion, each of which extends from the inlet to the outlet of the transition piece 100. The transition piece 100 is configured such that the lower (radially inward) portion is curved to enable the transition piece 100 to be coupled with the turbine inlet port 300, and the upper (radially outward) portion is also curved to enable the coupling. Here, since a difference in height between the upper portion of the transition piece 100 and the turbine inlet port 300 is greater than that of the lower portion of the transition piece 100, the degree to which the upper portion is curved is greater than that of the lower portion. The upper portion of the transition piece 100 includes a second curvature occurring toward the turbine inlet port 300. In the embodiment of the present disclosure, the curvatures of the transition piece 100 enable a precise coupling with the turbine inlet port 300 to prevent the combustion gas from leaking out.

Referring again to FIG. 2, a transition piece casing 110 is spaced apart from the transition piece 100 and encloses the transition piece 100. The transition piece casing 110 is configured to enable compressed air to effectively flow over the entire area of an outer circumferential surface of the transition piece 100. The transition piece casing 110 forms a cylindrical hollow space so that the transition piece 100 can be inserted into the transition piece casing 110. Thus, the transition piece casing 110 may have a shape corresponding, or similar, to that of the transition piece 100 so that the distance between the inner circumferential surface of the transition piece casing 110 and the outer circumferential surface of the transition piece 100 can remain constant over the entirety of the outer circumferential surface of the transition piece 100. However, the shape of the transition piece casing 110 is not particularly limited.

When the transition piece 100 is inserted into the hollow space of the transition piece casing 110, the transition piece 100 is spaced apart from an inner circumferential surface of the transition piece casing 110 so that an annular interspace is formed between the transition piece casing 110 and the transition piece 100. The transition piece casing 110 is seated on a support member 120 which will be described below.

At least one support member 120 is inserted into the annular interspace formed between the inner circumferential surface of the transition piece casing 110 and the outer circumferential surface of the transition piece 100 so that the transition piece casing 110 that encloses the transition piece 100 can be spaced apart from and supported on the transition piece 100. The support member 120 includes a convexly curved portion protruding in one direction (e.g., outwardly from the transition piece 100) and approximating a U shape. Thus, the support member 120 is a member having elasticity.

When the support member 120 is inserted into the annular interspace, the support member 120 is seated on the outer circumferential surface of the transition piece 100, and the convexly curved portion comes into contact with the inner circumferential surface of the transition piece casing 110 so that the support member 120 can support the transition piece casing 110. To support the transition piece 100, a plurality of support members 120 may be arranged in an annular configuration along the outer circumferential surface of the transition piece 100, as shown in FIG. 2, but this configuration is not particularly limited.

The transition piece casing 110 may include a plurality of cooling holes through which compressed air can be drawn into the transition piece casing 110. The size and the shape of any of the cooling holes are not limited. The cooling holes are formed in the transition piece casing 110 such that compressed air drawn from the compressor 10 can flow toward the outer circumferential surface of the transition piece 100 so as to cool the transition piece 100 heated by high-temperature combustion gas. Compressed air drawn through the cooling holes absorbs heat from the transition piece 100 while flowing toward the liner 400 through the annular interspace, thus preventing the transition piece 100 from being damaged by temperature rise.

Referring to FIGS. 2 to 4, the embodiment of the present disclosure includes a guide member 600 which guides compressed air flowing over the outer circumferential surface of the transition piece casing and toward an upper portion of the turbine casing 500 (FIG. 5) and redirects the flow (i.e., changes the flow direction) of the compressed air toward the transition piece 100. The present embodiment may be comprised of one or more guide members 600 each of which is fixed with respect to the transition piece casing 110 and includes an axially perpendicular structure for redirecting and guiding the compressed air flowing over the outer circumferential surface of the transition piece casing 110. The axially perpendicular structure, which may include one or more curvatures, extends generally in a direction perpendicular to the axis of the transition piece casing 110. The axially perpendicular structure of the guide member 600 extends between opposite end portions 601*a* and 601*b*, which are separated from each other in the direction perpendicular to the axis of the transition piece casing 110.

In addition to the axially perpendicular structure, the guide member 600 may further include a guide support 610 having one end fixed to the transition piece casing 110 so that the guide member 600 can be fixed in position with respect to the transition piece casing 110. The guide support 610 may be fixed to the outer circumferential surface of the transition piece casing 110 in a manner that is not limited.

The extending direction and configuration of the guide support 610 is not particularly limited. The guide support 610 is configured such that the axially perpendicular structure of the guide support 600 can be spaced apart from the transition piece casing 110. More particularly, a predetermined distance (space) is established between the axially perpendicular structure, more specifically, a guide surface 601 of a single guide 620 (described below), and the outer circumferential surface of the transition piece casing 110. The guide support 610 extends from the transition piece casing 110 by a distance enabling compressed air flowing over an upper side portion of the outer circumferential surface of the transition piece casing 110 can be effectively collected and guided by the guide surface of the axially perpendicular structure toward the transition piece casing 110. The distance from the transition piece casing 110 further enables compressed air flowing upward from the upper side portion of the outer circumferential surface of the transition piece casing 110 toward the turbine casing 500 can be similarly collected and guided.

The single guide 620 may be is fixed to one end of the guide support 610. The fixing method may include welding, bolt coupling, or the like, but is not particularly limited. The single guide 620 may have opposite end portions 601*a* and 601*b* oriented downward (radially inward) for collection of compressed air, as illustrated in FIG. 3, so that the single guide 620 can effectively collect compressed air that flows along opposite side portions of the outer circumferential surface of the transition piece casing 110 toward the upper portion of the turbine casing 500 and change the flow direction of the compressed air toward the transition piece 100.

With regard to a method of orienting the opposite end portions 601*a* and 601*b* of the single guide 620 downward, the opposite end portions 601*a* and 601*b* may be oriented downward by curving or bending a portion of the single guide 620. The method of forming the downwardly oriented end portions 601*a* and 601*b* of the single guide 620 is not particularly limited, provided that the opposite end portions 601*a* and 601*b* are oriented so as to guide compressed air colliding with the single guide 620 into the transition piece casing 110 without flowing out of the single guide 620. Since the opposite end portions 601*a* and 601*b* are formed in an inwardly curved manner or the like, the compressed air that collides with the guide member 600 is collected to be guided into the transition piece casing 110.

In the embodiment of the present disclosure, an inner guide 630 may be provided on one surface of the single guide 620 so that the single guide 620 can more smoothly guide the flow of compressed air toward the transition piece casing 110. The shape of the inner guide 630 is not decided to a particular shape. FIG. 3 illustrates an example in which the inner guide 630 has a thin plate shape curved in one direction.

One end of the inner guide 630 is oriented toward the transition piece casing 110 so that compressed air, which moves upward along the opposite side portions of the outer circumferential surface of the transition piece casing 110 and is collected toward a predetermined portion of the single guide 620 along the opposite ends of the single guide 620, can flow toward the transition piece casing 110. The one end of the inner guide 630 may be bent or curved toward the transition piece casing 110, and the method of orienting the one end of the inner guide 630 is not particularly limited.

To allow compressed air to more intensively flow toward the transition piece casing 110 through the inner guide 630, at least one pair of inner guides 630 are fixed to one surface of the single guide 620 that faces the transition piece casing 110. The fixing method may be a welding method, a bolt coupling method, or a sliding coupling method, and the fixing method is not particularly limited.

In the case where the one pair of inner guides 630 are fixed on one surface of the single guide 620, the one pair of inner guides 630 may be installed taking into account the fact that compressed air is drawn from the opposite ends of the single guide 620 toward the inner guides 630. To allow the thus drawn compressed air to efficiently flow toward the transition piece casing 110, the one pair of inner guides 630 may be installed on the single guide 620 such that, as illustrated in FIG. 3, the inner guides 630 are symmetrical with each other based on an imaginary plane drawn between the inner guides 630.

In the transition piece assembly in accordance with the embodiment of the present disclosure, the distance between the opposite end portions 601*a* and 601*b* of the perpendicular structure is greater than the distance between the opposite side portions of the transition piece casing 110. Hence, the amount of compressed air that can be collected may be increased. In detail, in the case where the transition piece casing 110 is cylindrical, the distance between the opposite side portions of the transition piece casing 110 refers to a distance on the outer circumferential surface of the transition piece casing 110, in other words, an outer diameter or width of the transition piece casing 110. To guide compressed air collected by the axially perpendicular structure 620 and guided toward the transition piece casing 110, the opposite end portions 601*a* and 601*b* may be formed by creating a curve or bend in the guide surface 601 in a radially inward direction, that is, toward the outer circumferential surface of the transition piece casing 110.

In this embodiment, the axially perpendicular structure of the guide member 600 is formed by the single guide 620. To increase the amount of collected compressed air, the single guide 620 may include a central protrusion 621 which extends in the axial direction, i.e., downstream, to have a partially protruding shape, as illustrated in FIGS. 8A and 8B. Thus, the central protrusion 621 extends from a downstream edge of the axially perpendicular structure (620). The shape of the central protrusion 621 is not particularly limited but may be formed in an approximately triangular shape (FIG. 8A) or an approximately trapezoidal shape (FIG. 8B) to increase an amount of compressed air that collides with the single guide 620 to be guided into the transition piece casing 110.

In a modification of the embodiment of the present disclosure, the transition piece assembly may include dual guides 622. That is, the axially perpendicular structure of the guide member 600 may be formed by the dual guides 622 each of which is fixed to one end of the guide support 610. The opposite end portions of each of the dual guides 622 may be bent or curved toward the transition piece casing 110 in a manner the same as or similar to that described above with respect to the axially perpendicular structure (620).

Each of the dual guides 622 may be individually fixed by the guide support 610 that is fixed to and extends from the transition piece casing 110. Alternatively, the dual guides 622 may be fixed by a guide support 610 having a width large enough to accommodate both guides 622. The form of supporting either of the dual guides 622 is not particularly limited.

As illustrated in FIG. 4, the guide support 610 that supports the dual guides 622 may be fixed to two portions of an end of the transition piece casing 110 and extend from the two portions. In this case, the guide support 610 is formed as if the ends of the guide support 610 that extend from the two portions of the transition piece casing 110 are connected to each other by a connector, whereby the guide support 610 is formed into a single body. In the case of the guide support 610 having the foregoing configuration, the dual guides 622 are seated on and fixed to the surface of the connector and thus may guide compressed air toward the transition piece casing 110.

The dual guides 622 seated on the guide support 610 may form a symmetrical structure so that each guide 622 can uniformly guide compressed air toward the transition piece casing 110. The symmetry of the symmetrical structure is established about an imaginary plane drawn between the dual guides 622. Thus, the dual guides 622 may be symmetrically arranged with respect to each other and may be respectively configured to guide a portion of the compressed air into the transition piece casing 110.

The guide support 610 included in the transition piece assembly in accordance with the embodiment of the present disclosure may include a mount 612 and a rotatable arm 614. The mount 612 may be seated on and fixed to the transition piece casing 110, and the rotatable arm 614 may be rotatably provided to allow the guides 622 to be changed in position. The mount 612 and rotatable arm 614 configuration may be equally applied to the embodiments of FIGS. 2 and 3. In other words, the axially perpendicular structure 620 may be provided with the mount 612 and rotatable arm 614 to allow the structure 620 to be changed in position in the same manner as shown in FIG. 4.

The mount 612 includes a distal end portion extending from the transition piece casing 110, enabling the rotatable arm 614 to be coupled to the mount 612 by a bolt coupling method or the like to allow the rotatable arm 614 to rotate about the distal end portion of the mount 612. The rotatable arm 614 is preferably coupled the mount 612 at the distal end portion, which may have one surface making contact with and facing a corresponding surface of a lower end of the rotatable arm 614. Provided the rotatable arm 614 is rotatable, its coupling method is not particularly limited.

Although not specifically illustrated, the mount 612 may have a cuboidal shape in which, among four side surfaces, an upper surface and two opposite side surfaces are open. In this case, the rotatable arm 614 is inserted into the mount 612 through the open upper surface of the mount 612 so that the rotatable arm 614 is rotatable within the open opposite side surfaces.

Since the guide support 610 includes the rotating bar 614, the position of the single guide 620 or dual guides 622 can be changed taking into account the size of the transition piece casing 110 or the position at which the guide member 600 is installed.

Referring to FIGS. 5 and 6, a transition piece assembly in accordance with another embodiment of the present disclosure may include a transition piece 100, a transition piece casing 110, and a support member 120 as in the case of the embodiments of FIGS. 2 to 4, and the transition piece assembly further includes a turbine casing 500. In this case, a guide member 6000 having an axially perpendicular structure is substituted for the guide member 600 having an axially perpendicular structure. In any event, a guide member 6000 is fixed with respect to the transition piece casing 110 and is configured to guide the compressed air toward the transition piece casing. To do so, the guide member 6000 is provided with a turbine casing guide 6200 that is fixed to the inner wall of the turbine casing 500 and includes a guide surface 6001, which faces the outer circumferential surface of the transition piece casing 110 so that the compressed air is guided into the transition piece casing 110. Here, the compressed air being guided by the guide surface 6001 includes compressed air that flows over the outer circumferential surface of the transition piece casing 110 and toward an upper portion of the turbine casing 500.

The turbine casing 500 is spaced apart from the transition piece casing 110 and encloses the transition piece casing 110 to prevent compressed air drawn from the compressor 10 from leaking out. Compressed air through the turbine casing 500 may flow to the liner 400 through the cooling holes formed in the transition piece casing 110 without leaking out.

As illustrated in FIGS. 5 and 6, the guide member 6000 is seated on and fixed to an inner wall of the turbine casing 500, and includes a coupling crosspiece 6100 which is coupled to a sidewall of the turbine casing 500 and fixes the guide member 6000 to the turbine casing 500, and the turbine casing guide 6200 which guides compressed air to the transition piece casing 110. FIG. 5 schematically illustrates a location of the guide member 6000 coupled to the inner wall of the turbine casing 500 but does not illustrate structural details such as its curvature.

The turbine casing guide 6200 collects compressed air and guides the compressed air to the transition piece casing 110, and has a structure similar to that of the single guide 620 described in the foregoing embodiment; therefore, repetitive explanation will be omitted. For example, the turbine casing guide 6200 may be provided with features of the single guide 620, including the opposite end portions 601*a* and 601*b*.

Compressed air that flows on one surface of the turbine casing guide 6200 is not subjected to resistance.

The turbine casing guide 6200 is coupled to the inner wall of the turbine casing 500 so that the turbine casing guide 6200 can be fixed at a position facing the transition piece casing 110. Therefore, compressed air that moves upward in the turbine casing 500 may be changed in direction by the turbine casing guide 6200 and focused onto the transition piece casing 110.

In another embodiment of the present disclosure, as illustrated in FIG. 6, the coupling crosspiece 6100 may have a flat plate shape. One side of the coupling crosspiece 6100 may have a shape corresponding to that of one side of the turbine casing guide 6200 so that the coupling crosspiece 6100 can be joined with the turbine casing guide 6200. A plurality of coupling holes (not shown) through which the coupling crosspiece 6100 can be coupled to the sidewall of the turbine casing 500 by bolting may be formed in a surface of the coupling crosspiece 6100 that is exposed after the coupling crosspiece 6100 is joined with the turbine casing guide 6200. However, the shape or the coupling method of the coupling crosspiece 6100 is not particularly limited so long as the coupling crosspiece 6100 can be coupled to the sidewall of the turbine casing 500 and thus fix and support the guide member 6000.

In another embodiment of the present disclosure, as illustrated in FIG. 6, the guide member 6000 may further include at least one rib 6300 to prevent the turbine casing guide 6200 and the coupling crosspiece 6100 from being separated from each other by the flow of compressed air and to reinforce the support of the turbine casing guide 6200 by the coupling crosspiece 6100.

One side of each of the ribs 6300 is joined with and fixed to one surface of the coupling crosspiece 6100. Another side of the rib 6300 is joined with and fixed to one surface of the turbine casing guide 6200. Thereby, the turbine casing guide 6200 may be prevented from being dislodged.

In another embodiment of the present disclosure, a length of the junction of the rib 6300 with the coupling crosspiece 6100 and the turbine casing guide 6200 is similar to a width of the coupling crosspiece 6100 and the turbine casing guide 6200, and the shape of the rib 6300 may be similar to an approximately trapezoidal shape. However, the shape of the rib 6300 is not particularly limited.

Opposite end portions of the turbine casing guide 6200 may be curved in the same manner as that described in the foregoing embodiment of the present disclosure so that compressed air can be more efficiently guided to the transition piece casing 110. As described in the foregoing embodiment of the present disclosure, an inner guide 630 may be provided on one surface of the turbine casing guide 6200 that faces the transition piece casing 110. Furthermore, as described above, the distance between the opposite ends of the turbine casing guide 6200 is greater than the distance between the opposite side portions of the transition piece casing 110, so that compressed air can be more efficiently collected and guided to the transition piece casing 110. Characteristics of the turbine casing guide 6200 are similar to that of the embodiments of FIGS. 2 to 4; therefore, repetitive explanation will be omitted.

In another embodiment of the present disclosure, a transition piece module including a plurality of transition piece assemblies arranged in an annular shape may be implemented. Each of the plurality of transition piece assemblies may include a transition piece 100, a transition piece casing 110, and a support member 120 consistent with those of the above-described embodiments. For example, the transition piece 100 may include an inlet into which high-temperature combustion gas is drawn and an outlet from which the combustion gas is discharged toward a turbine inlet port 300; the transition piece casing 110 may be spaced apart from the transition piece 100 and enclose the transition piece 100, and the support member 120 may be inserted into space formed by spacing the transition piece 100 apart from the transition piece casing 110 and seated on an outer circumferential surface of the transition piece 100 to support the transition piece 100. The transition piece module may also include at least one guide member 600 or 6000 which guide compressed air that flows along the outer circumferential surface of the transition piece casing 110 toward the transition piece casings 110 and are disposed between the adjacent transition piece casings 110. Each of the guide members 600 or 6000 includes a single guide 620 or turbine casing guide 6200 to guide compressed air, and a guide support 610 to fix the guide 620, 6200.

As illustrated in FIG. 7, in another embodiment of the present disclosure, the single guides 620 are disposed between the transition piece casings 110. The single guides 620 may be designed to be seated at a position higher than the transition piece casings 110 so that compressed air that rises upward can efficiently flow onto upper surfaces of the transition piece casings 110. A scheme of seating the single guide 620 is not particularly limited.

The guide support 610 is seated on an end portion of each transition piece casing 110, extends in one direction, and is coupled with the corresponding guide 620. Thereby, the guide 620 may be fixed between the transition piece casings 110. The shape of the guide support 610 is not particularly limited so long as the guide support 610 extends in one direction so that the guide 620 can be spaced apart from the transition piece casing 110. Although the guide support 610 may have various shapes, as illustrated in FIG. 4, the guide support 610 is fixed to the end portion of the transition piece casing 110 and extends in at least one direction so that the guide 620 can be spaced apart from the transition piece casing 110. In general, the guides 620 or 6200 of the embodiment of FIG. 7 may be structured as described in the embodiments of FIGS. 2 to 4, including opposite end portions 601*a* and 601*b*.

As shown in FIG. 7, the opposite end portions of the guides 620 or 6200 include a first end portion curved inwardly toward a first transition piece casing 110 of an adjacent pair of transition piece assemblies and a second end portion curved inwardly toward a second transition piece casing 110 of the adjacent pair of transition piece assemblies. The opposite end portions are configured to collect the compressed air that collides with the guide member 600 or 6000 and to guide the collected compressed air into the first and second transition piece casings.

The guide member 6000 included in the transition piece module in accordance with another embodiment of the present disclosure may include a turbine casing guide 6200 which guides compressed air to the transition piece casing 110, and a coupling crosspiece 6100 which couples the turbine casing guide 6200 to the inner wall of the turbine casing 500. As illustrated in FIG. 6, the coupling crosspiece 6100 may extend in one direction from an end portion of the turbine casing guide 6200, be formed in an approximately plate shape, and be fixed to the inner wall of the turbine casing 500 by a method such as a welding method or a bolt coupling method.

As illustrated in FIGS. 8A and 8B, the guide 620, 6200 may include a central protrusion 621 which extends in one direction to collect a comparatively large amount of rising compressed air and guide the compressed air to the transition piece casing 110. The central protrusion 621 extends in one direction from one surface of the guide 620, 6200 and has a protruding shape, as illustrated in FIGS. 8A and 8B.

The guide 620, 6200 is disposed between adjacent transition piece casings 110. Hence, to prevent the guide 620, 6200 from coming into contact with the transition piece casing 110 that is curved upward as illustrated in FIG. 5, the central protrusion 621 may protrude in an approximately triangular or trapezoidal shape from the guide 620, 6200 by cutting away opposite side portions of a downstream edge of the guide 620, 6200, as illustrated in FIGS. 8A and 8B. However, the protruding shape is not particularly limited.

The amount of rising compressed air that flows toward the transition piece casing 110 may be increased by the protrusion that extends in one direction from one surface of the guide 620, 6200, whereby the efficiency of cooling the transition piece casing 110 can be effectively increased.

Another embodiment of the present disclosure may include a combustor 20 provided with the above-described transition piece assembly. The combustor 20 may include a fuel nozzle module 410' which includes a plurality of fuel nozzle assemblies 410 configured to supply fuel, a casing 420 which encloses the fuel nozzle module 410', a liner 400 which is coupled with the fuel nozzle module 410' and has internal space in which a fuel-air mixture is ignited and combusted, a liner casing 430 which encloses the liner 400, and a transition piece assembly which is coupled with the liner 400 and the liner casing 430. The transition piece assembly may include all of the characteristics described above.

Another embodiment of the present disclosure may include a gas turbine 1 provided with the above-described transition piece assembly. The gas turbine 1 may include a compressor 10 which draws air thereinto and forms compressed air, a combustor 20 which combusts a fuel-air mixture formed by mixing the compressed air with fuel and thus forms high-temperature combustion gas, and a turbine 30 which is driven by the combustion gas. Here, the combustor 20 is consistent with the above-mentioned combustor 20 and thus refers to a combustor 20 including the transition piece assembly described above in this specification.

In embodiments of the present disclosure, cooling efficiency using compressed air may be increased so that a transition piece and a transition piece casing can be prevented from being thermally deformed or damaged by heat transferred from high-temperature combustion gas.

While the present disclosure has been described with respect to the specific embodiments, it will be apparent to those skilled in the art that various changes and modifications may be made without departing from the spirit and scope of the disclosure as defined in the following claims.

What is claimed is:

1. A transition piece assembly comprising:

a transition piece including an inlet into which high-temperature combustion gas is drawn, and an outlet from which the combustion gas is discharged to a turbine inlet port;

a transition piece casing disposed so as to be spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows to cool the transition piece;

a support member for supporting the transition piece casing, the support member inserted into the annular interspace and seated on the outer circumferential surface of the transition piece; and a guide member that is fixed with respect to the transition piece casing and includes an axially perpendicular structure configured to guide the compressed air toward the transition piece casing, wherein the axially perpendicular structure of the guide member comprises a central protrusion that extends from the axially perpendicular structure in a downstream direction and is configured to increase an amount of compressed air that collides with the axially perpendicular structure to be guided into the transition piece casing.

2. The transition piece assembly according to claim 1, wherein the axially perpendicular structure of the guide member comprises:

a single guide including a guide surface that is formed on the axially perpendicular structure and that faces the outer circumferential surface of the transition piece casing so that the compressed air is guided into the transition piece casing.

3. The transition piece assembly according to claim 1, wherein the axially perpendicular structure of the guide member comprises:

dual guides symmetrically arranged with respect to each other and respectively configured to guide a portion of the compressed air into the transition piece casing, each of the dual guides including a guide surface that is formed on the axially perpendicular structure and that faces the outer circumferential surface of the transition piece casing so that the compressed air is guided into the transition piece casing.

4. The transition piece assembly according to claim 1, further comprising:

a turbine casing spaced apart from the transition piece casing and configured to enclose the transition piece casing, the turbine casing having an inner wall facing the transition piece casing, wherein the axially perpendicular structure of the guide member comprises:

a turbine casing guide that is fixed to the inner wall of the turbine casing and includes a guide surface facing the outer circumferential surface of the transition piece casing so that the compressed air, which flows over the outer circumferential surface of the transition piece casing and toward the turbine casing, is guided into the transition piece casing.

5. The transition piece assembly according to claim 4, wherein the turbine casing guide further comprises:

a coupling crosspiece that is coupled to the inner sidewall of the turbine casing and is configured to support the turbine casing guide with respect to the transition piece casing.

6. The transition piece assembly according to claim 5, wherein the turbine casing guide further comprises:

at least one rib structurally contacting one surface of the coupling crosspiece, wherein the one surface of the coupling crosspiece faces away from the inner wall of the turbine casing, and the at least one rib is configured to reinforce the support of the turbine casing guide by the coupling crosspiece.

7. The transition piece assembly according to claim 5, wherein the turbine casing guide further comprises:

at least one rib structurally contacting one surf ace of the turbine casing guide, wherein the one surface of the turbine casing guide faces away from the guide surface of the turbine casing guide, and the at least one rib is configured to reinforce the support of the turbine casing guide by the coupling crosspiece.

8. The transition piece assembly according to claim 7, wherein the at least one rib makes structural contact with one surface of the coupling crosspiece, the one surface of the coupling crosspiece facing away from the inner wall of the turbine casing.

9. The transition piece assembly according to claim 1, wherein the axially perpendicular structure of the guide member comprises:

opposite end portions that are respectively curved downwardly toward the transition piece casing and are configured to collect the compressed air that collides with the guide member and to guide the collected compressed air into the transition piece casing.

10. The transition piece assembly according to claim 9, wherein the opposite end portions are separated by a distance greater than a distance between opposite side portions of the transition piece casing.

11. The transition piece assembly according to claim 1, wherein the axially perpendicular structure of the guide member comprises:

at least one inner guide having one end portion oriented toward the transition piece casing.

12. The transition piece assembly according to claim 11, wherein the at least one inner guide comprises a pair of inner guides disposed so as to be symmetrical with each other and to face each other.

13. The transition piece assembly according to claim 1, wherein the guide member further comprises:

a guide support that is fixed to the transition piece casing and is configured to support the guide member with respect to the transition piece casing; and a guide surface that is formed on the axially perpendicular structure and faces the outer circumferential surface of the transition piece casing so that the compressed air is guided into the transition piece casing.

14. The transition piece assembly according to claim 13, wherein the guide support comprises:

a mount disposed on the transition piece casing; and a rotatable arm having opposite ends respectively coupled to the mount and the guide member, the rotatable arm configured to rotate such that the guide surface changes its position relative to the transition piece casing.

15. A transition piece module comprising a plurality of transition piece assemblies arranged in an annular configuration, each of the transition piece assemblies comprising:

a transition piece including an inlet into which high-temperature combustion gas is drawn, and an outlet from which the combustion gas is discharged to a turbine inlet port;

a transition piece casing disposed so as to be spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows to cool the transition piece; and a support member for supporting the transition piece casing, the support member inserted into the annular interspace and seated on the outer circumferential surface of the transition piece, wherein the plurality of transition piece assemblies include an adjacent pair transition piece assemblies, wherein the transition piece module further comprises a guide member that is disposed between the transition piece casings of the adjacent pair of transition piece assemblies and that includes an axially perpendicular structure configured to guide the compressed air toward the transition piece casings of the adjacent pair of transition piece assemblies, and wherein the axially perpendicular structure of the guide member comprises a central protrusion that extends from the axially perpendicular structure in a downstream direction and is configured to increase an amount of compressed air that collides with the axially perpendicular structure to be guided into the transition piece casing.

16. The transition piece module according to claim 15, wherein the guide member further comprises:

a guide support that is fixed to at least one of the transition piece casings of the adjacent pair of transition piece assemblies and is configured to support the guide member with respect to the at least one of the transition piece casings; and a guide surface that is formed on the axially perpendicular structure and faces the outer circumferential surfaces of the transition piece casings of the adjacent pair of transition piece assemblies so that the compressed air is guided into the transition piece casings of the adjacent pair of transition piece assemblies, wherein the axially perpendicular structure of the guide member comprises opposite end portions including a first end portion curved downwardly toward a first transition piece casing of the adjacent pair of transition piece assemblies and a second end portion curved downwardly toward a second transition piece casing of the adjacent pair of transition piece assemblies, and wherein the opposite end portions are configured to collect the compressed air that collides with the guide member and to guide the collected compressed air into the first and second transition piece casings.

17. The transition piece module according to claim 15, further comprising:

a turbine casing spaced apart from the transition piece casing and configured to enclose the transition piece casing, the turbine casing having an inner wall facing the transition piece casing, wherein the axially perpendicular structure of the guide member comprises:

opposite end portions including a first end portion curved downwardly toward a first transition piece casing of the adjacent pair of transition piece assemblies and a second end portion curved downwardly toward a second transition piece casing of the adjacent pair of transition piece assemblies, the opposite end portions configured to collect the compressed air that collides with the guide member and to guide the collected compressed air into the first and second transition piece casings; and a turbine casing guide that is fixed to the inner wall of the turbine casing and includes a coupling crosspiece that is coupled to the inner wall of the turbine casing and is configured to support the turbine casing guide with respect to the transition piece casing, and a guide surface that is formed on the axially perpendicular structure and faces the outer circumferential surfaces of the transition piece casings of the adjacent pair of transition piece assemblies so that the compressed air is guided into the transition piece casings of the adjacent pair of transition piece assemblies.

18. A combustor for producing combustion gas by combusting a mixture of compressed air and fuel, the combustor comprising a fuel nozzle module including a plurality of fuel nozzle assemblies configured to supply the fuel; a casing enclosing the fuel nozzle module; a liner coupled with the fuel nozzle module and having internal space in which the fuel-air mixture is combusted; a liner casing enclosing the liner; and a transition piece assembly coupled with the liner and the liner casing, wherein the transition piece assembly comprises:

a transition piece including an inlet into which high-temperature combustion gas is drawn, and an outlet from which the combustion gas is discharged to a turbine inlet port;

a transition piece casing disposed so as to be spaced apart from the transition piece, the transition piece casing enclosing the transition piece to form an annular interspace between an inner circumferential surface of the transition piece casing and an outer circumferential surface of the transition piece, the transition piece casing including an outer circumferential surface over which compressed air flows to cool the transition piece;

a support member for supporting the transition piece casing, the support member inserted into the annular interspace and seated on the outer circumferential surface of the transition piece; and a guide member that is fixed with respect to the transition piece casing and includes an axially perpendicular structure configured to guide the compressed air toward the transition piece casing, wherein the axially perpendicular structure of the guide member comprises a central protrusion that extends from the axially perpendicular structure in a downstream direction and is configured to increase an amount of compressed air that collides with the axially perpendicular structure to be guided into the transition piece casing.

19. A gas turbine comprising the combustor according to claim 18 and further comprising:

a compressor configured to generate the compressed air from air drawn in from an outside; and a turbine configured to be driven by the combustion gas.

* * * * *